US006551413B2

(12) United States Patent
Lordo et al.

(10) Patent No.: US 6,551,413 B2
(45) Date of Patent: Apr. 22, 2003

(54) HIGH SPEED PICKLING WITH RECYCLING OF ACID

(75) Inventors: Richard Kenneth Lordo, Hermitage, PA (US); Thomas Sven Persson, Youngstown, OH (US)

(73) Assignee: Danieli Technology, Inc., Cranberry Township, PA (US)

( * ) Notice: Subject to any disclaimer, the term of this patent is extended or adjusted under 35 U.S.C. 154(b) by 50 days.

(21) Appl. No.: 09/832,561

(22) Filed: Apr. 11, 2001

(65) Prior Publication Data

US 2001/0011547 A1 Aug. 9, 2001

Related U.S. Application Data

(63) Continuation of application No. 09/315,667, filed on May 20, 1999, now Pat. No. 6,260,563.

(51) Int. Cl.[7] ..... B08B 1/02
(52) U.S. Cl. ..... 134/15
(58) Field of Search ..... 134/15, 64 R, 134/122 R

(56) References Cited

U.S. PATENT DOCUMENTS 3,473,962 A 10/1969 Hampel
3,625,232 A 12/1971 Speelmanns
3,648,593 A 3/1972 Marshall
3,803,996 A 4/1974 Marshall
4,007,750 A 2/1977 Galloway
4,592,784 A 6/1986 Ghizzi
4,950,333 A 8/1990 Hone et al.
4,951,694 A 8/1990 Hone et al.
4,996,998 A 3/1991 Seiz et al.
5,116,447 A 5/1992 Kimura et al.
5,179,967 A 1/1993 Mattiussi
5,716,455 A 2/1998 Zednicek et al.
5,803,981 A 9/1998 Lordo
5,853,495 A 12/1998 Gravert et al.
6,016,819 A 1/2000 Murray et al.
6,260,563 B1 * 7/2001 Lordo et al. ..... 134/122 R

FOREIGN PATENT DOCUMENTS

EP 0 795 629 A1 9/1997

* cited by examiner

*Primary Examiner*—Randy Gulakowski
*Assistant Examiner*—Saeed T Chaudhry
(74) *Attorney, Agent, or Firm*—Paul A. Beck & Associates

(57) ABSTRACT

In high speed pickling and other fluid treatment of metal strip, the acid or other medium is carried along with the strip, and the momentum of the treatment fluid is utilized in a flow reversal path to reverse the flow and carry the fluid on a receiving surface which directs it for recycling to the upstream end of a flow reversal zone; this procedure is repeated in at least one sequential iteration.

4 Claims, 2 Drawing Sheets

HIGH SPEED PICKLING WITH RECYCLING OF ACID

RELATED APPLICATION

This Continuation application claims the benefit of application Ser. No. 09/315,667 that was filed on May 20, 1999 now U.S. Pat. No. 6,260,563.

TECHNICAL FIELD

This invention relates to treating steel, particularly to the pickling of steel, and more particularly to the control of the pickling bath used for pickling steel strip moving at high speeds.

BACKGROUND OF THE INVENTION

In the past ten to fifteen years there has been considerable evolution in the pickling of steel. The art has progressed from simple dip tanks to horizontal pickling tanks and on to the extremely advanced turboflow systems, which led to the generation of more ecological and economical processes, all the while improving the quality of the treatment that the material had to undergo. Nevertheless, virtually all of the newer treatment facilities (primarily steel strip picking plants) were designed for hot strips with thicknesses ranging from 1.8 to 6 millimeters. Average strip thickness throughout the world is about 3 millimeters.

Today, thanks to the hot rolling technology combined with the thin slab casting technology, the hot strip sector produces thicknesses as low as 0.7 millimeters while retaining the ability to handle 6 mm in thickness. In order to produce substantially thinner hot strips in the plants, the strip must run at higher speeds during treatment. For example, with a production of 1.5 million tons per year and a 3 mm thick reference strip, strip speed is 250 meters per minute. With a 1.5 mm thick strip, processing speed at the same production capacity is 500 meters per minute; 400 meters per minute is to be expected for strip 2.4 mm thick at the same production rate.

Pickling technologies currently available on the market are generally not compatible with such high speeds, since the facility is usually designed to propel the strip through a horizontal pickling plant under low tension. This presents guiding problems, and the added condition of high speed of the strip causes the strip to carry the pickling liquid on its surface. If the strip is propelled horizontally into the acid bath with considerable kinetics, the quantity of liquid carried away may be so great that adequate pickling and safe operation are difficult to guarantee. A boundary layer of acid tends to remain stationary with respect to the strip, resulting in poor contact efficiency.

In the past, pickling tanks and their covers have been constructed to control acid vapors, as in U.S. Pat. Nos. 3,803,996 and 3,648,593 to Marshall and U.S. Pat. No. 4,592,784 to Ghizzi. Weirs have been used to create cascades of acid from one tank or zone to the next. See Hampel U.S. Pat. No. 3,473,962 and Matiussi U.S. Pat. No. 5,179,967. Acid has been collected in separate vessels for recycling, as in Galloway U.S. Pat. No. 4,007,750 and Gravert et al U.S. Pat. No. 5,853,495; note also Zednicek et al U.S. Pat. No. 5,716,455, which discloses restrictions constructed to shear the acid on the strip, causing turbulence; the acid is recycled through drains. In pickling wire, Hone et al in U.S. Pat. Nos. 4,950,333 and 4,951,694 utilize the dynamics of the process by generating waves of acid, which are controlled by weirs.

Acid is recycled from a high end of an acid tank to a low end by gravity through a pipe, as configured by Lordo in U.S. Pat. No. 5,803,981. Kimura et al, in U.S. Pat. No. 5,116,447, recycles "wakes" of acid stripped by weir members shaped to direct the excess acid to the sides of the weirs for draining.

As indicated above, the kinetics of the extremely high speed of the newer pickling lines results in rapid movement of the acid in the bath, particularly that above the strip, towards the downstream end of the process and apparatus. This causes increasing depths of acid in the downstream ends of the pickling vessels, compounding the hazards for workers and causing environmental problems due to the possibility of acid escaping from the apparatus, and economic loss from the underuse of the acid.

SUMMARY OF THE INVENTION

Our invention makes possible the efficient pickling of strip steel moving at high speeds while conserving acid and providing improved ecological and economic benefits. It is applicable not only for high speed pickling, but also for other high-speed strip treatment, such as rinsing and cleaning.

Our invention comprises a pickling apparatus for pickling steel strip traveling at high speed substantially horizontally, including a plurality of acid-containing sections in series for contacting said strip with acid, each of said acid-containing sections comprising an upstream end and a downstream end, comprising (a) means for maintaining a desired level of strip therein while permitting acid to flow on the bottom as well as the top thereof, (b) an exit for the strip in the downstream end including an arcuate deflector for acid flowing with the strip and on top thereof, the arcuate deflector being shaped so as to scoop the flowing acid and reverse its direction of flow at a level higher than that of the acid on the strip, and (c) an inclined separator panel for receiving acid from the deflector in the reverse direction of flow and guiding it downwardly to the upstream end of the section.

Below the deflector, we place a constriction on the flow of acid on top of the strip, followed by a divergent zone. The constriction, combined with the divergent zone, accelerates the flow of the acid remaining on top of the strip so that it is no longer merely carried by the strip. The constriction also aids the function of the deflector by urging the higher levels of acid upwardly towards the deflector so they can be recirculated.

Our invention optionally includes the use of a special cover for the pickling tanks and other optional features and variations, as will be seen below.

DETAILED DESCRIPTION OF THE INVENTION

Figure 1:
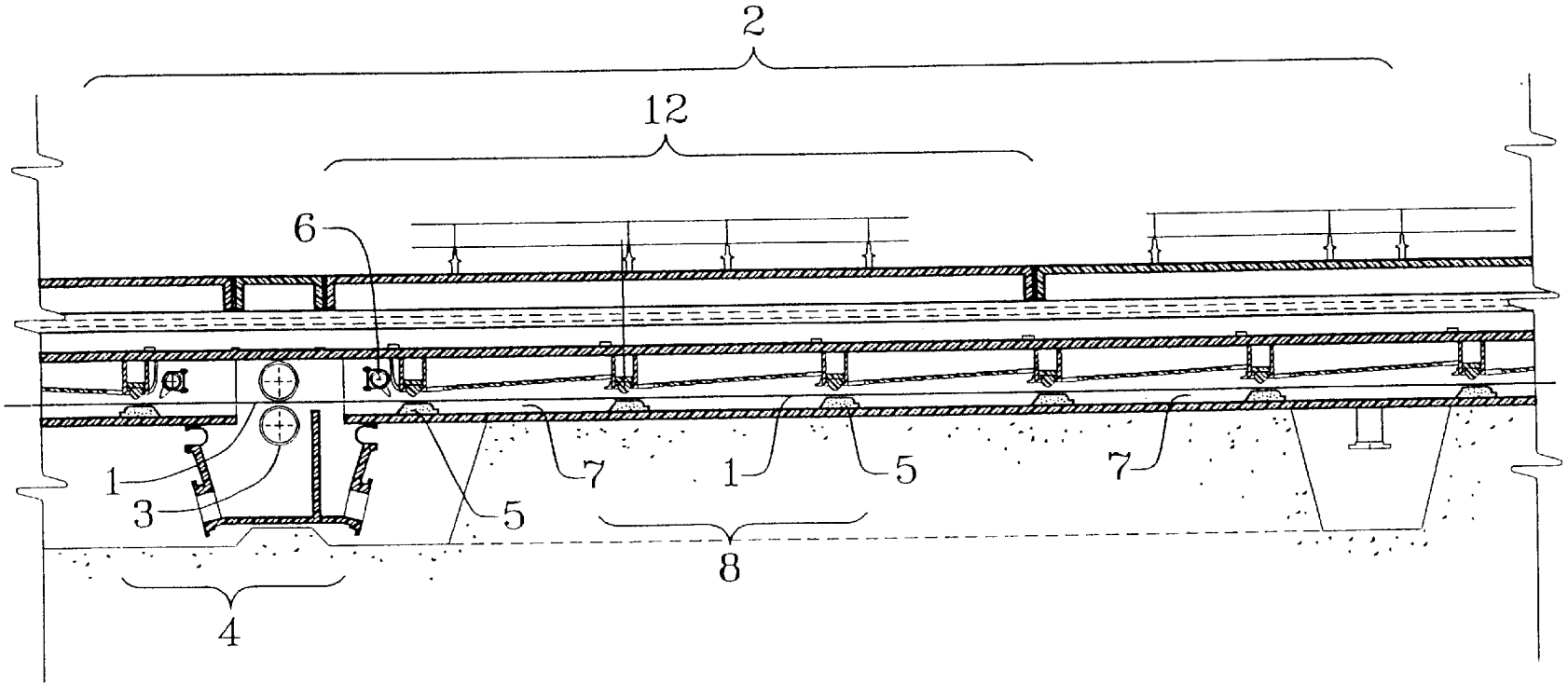
FIG. 1 is a side sectional view of a portion of a high speed strip pickling line including our invention. No acid is shown in this depiction.

Referring now to FIG. 1, steel strip 1 moves through the pickling facility 2 at a high speed—that is, at least 150 meters per minute, and possibly 400 or 500 meters per minute—brought about by any conventional means, not shown. It is initially held at the desired level by wringer rolls 3 in advancing chamber 4 and then is held at a desired level by slabs 5 interspersed in the facility 2. Slabs 5 may be made of granite, polypropylene, or other material more or less impervious to the acid, as is known in the art. Slabs 5 divide the acid bath into bath sections 8. Tank cover 12 covers three bath sections 8. Wringer rolls similar to wringer rolls 3 may be located at the downstream end of facility 2, not shown. Pickling acid may be introduced through sprays 6 directly onto the upper side of moving strip 1 and preferably may substantially fill the bath section 8, thoroughly immersing strip 1. The pickling acid forms a bath 7 which contacts the under side of the strip 1.

Figure 2:
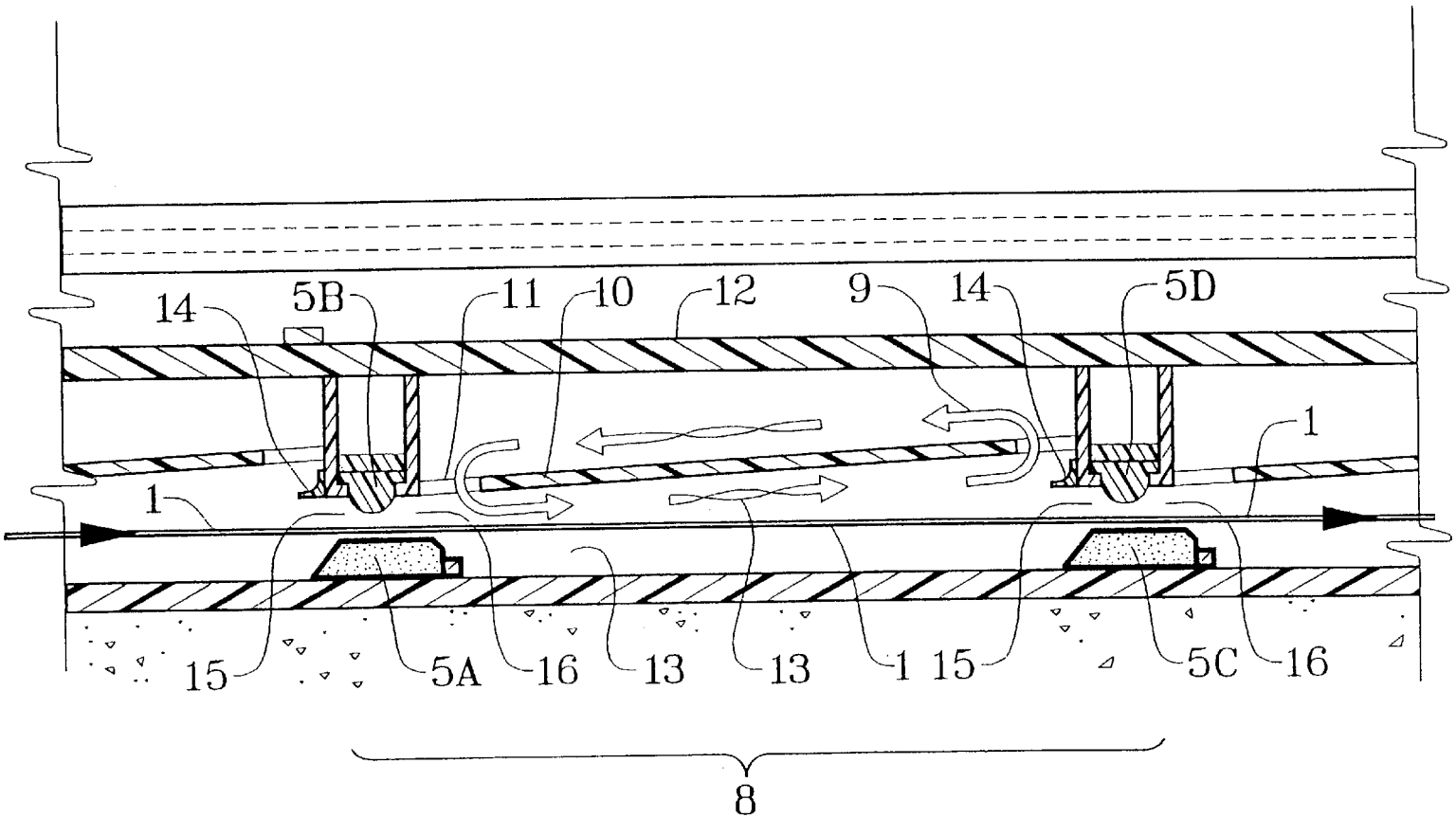
FIG. 2 is a similar view of just one section of the pickling line, permitting a better understanding of its effect.

In FIG. 2, the upstream end of bath section 8 is defined by lower slab 5A and upper slab 5B, and the downstream limits are defined by lower slab 5C and upper slab 5D. The acid 13 is swept along with the moving strip within each bath section 8, so that it flows towards the downstream end of bath section 8. The upper levels of the acid in the downstream end are caught by deflector 14, which may have an arcuate configuration similar to a snowplow, tending to reverse the direction of flow of the acid, as shown by arrow 9. Acid emerging from the top edge of deflector 14 is carried by its kinetic energy in the direction of the upstream end of bath section 8, and flows onto the surface of separator panel 10. Separator panel 10 has a slight incline downwards towards the upstream end of bath section 8; the acid thus flows back to the upstream end of bath section 8 and flows, drains, or is drawn downwardly through openings 11 onto the surface of strip 1.

Separator panel 10 may be built into each bath section 8 or may be built into the tank cover 12, which may also include upper slabs 5B and 5D. The separator panel 10 may contain channels or corrugations to ensure that the acid does not tend to flow to one side or the other of the separator panel 10. Openings 11 may be built into the separator panel 10 or be continuous across the width of bath section 8.

It should be noted that rounded slabs 5B and 5D form a constriction 15 on the flow of the portion of acid not subject to flow reversal as shown by arrow 9. The constriction 15 tends to accelerate the flow on the top of and underneath the strip 1 and is followed downstream by a diverging zone 16, which accelerates and adds turbulence to the flow of acid on top of and underneath strip 1 while recirculated acid is added to it through openings 11. The acceleration of the acid in divergent zone 16 tends to create a negative pressure with respect to the acid above openings 11, helping to draw the acid down and through openings 11, which in turn assists the overall circulation pattern above the strip 1 illustrated by arrows 9 and 13. The constriction 15, together with diverging zone 16, contributes to the efficiency of the treatment step by enhancing the contact of the acid with the strip 1 both by impressing contact of the acid on the strip and by causing turbulence within it.

By reversing the flow of a significant portion of the acid in each segment (tank) and recirculating it within the segment, our invention helps to reduce cross contamination from tank (segment) to tank (segment) where it is desired to maintain different acid concentrations in the segments.

Our invention is not limited in its application to pickling baths, but may be used with other types of fluid treatment systems for high speed strip, such as rinsing and cleaning. It will be seen that our invention includes a method of recycling strip treatment fluid in a high speed strip treatment bath, wherein the treatment fluid is carried at high speed along with and on top of a strip, comprising (a) guiding the treatment fluid carried along with and on top of the strip upwardly and in a flow reversal path designed to employ the momentum of the treatment fluid to reverse the direction of flow of the treatment fluid, (b) guiding the treatment fluid, preferably using its kinetic energy, onto a receiving surface above the treatment fluid being carried with the strip, and (c) guiding the treatment fluid flowing in a reversed direction to a point upstream of the flow reversal path and recycling the treatment fluid by depositing the treatment fluid on the strip.

What is claimed is:

1. Method of recycling strip treatment fluid in a high speed strip treatment bath, wherein said strip treatment fluid is carried at high speed along with a strip, comprising (a) guiding said treatment fluid carried along with and on top of said strip in a flow reversal path designed to employ the momentum of said treatment fluid to reverse the direction of flow of said treatment fluid, wherein an arcuate deflector reverses the direction of flow of said treatment fluid (b) receiving said treatment fluid on a separator panel between said treatment fluid being carried with said strip and said treatment fluid flowing in a reversed direction, wherein said separator panel is inclined for receiving said treatment fluid from said arcuate deflector and (c) guiding said treatment fluid flowing in a reversed direction on said separator panel to a point upstream of said flow reversal path and recycling said treatment fluid by depositing said treatment fluid from said separator panel onto said strip, guiding said treatment fluid with said strip into at least one additional flow reversal path and repeating steps (a), (b) and (c) in said at least one additional flow reversal path.

2. Method of claim 1 wherein said separator panel is substantially planar.

3. Method of claim 1 wherein said separator panel is corrugated.

4. Method of claim 1 including, at a point below said flow reversal path, guiding a portion of said fluid on top of said strip into a constriction and then into a divergent zone, whereby the flow of said portion of said fluid accelerates and becomes turbulent in said divergent zone.

* * * * *